US006032929A

United States Patent [19]

Vatne

[11] Patent Number: 6,032,929

[45] Date of Patent: Mar. 7, 2000

[54] ARRANGEMENT IN CONNECTION WITH A YOKE IN A HOISTING SYSTEM FOR A DERRICK

[75] Inventor: Per Vatne, Rabbersvik, Norway

[73] Assignee: Maritime Hydraulics AS, Kristiansand, Norway

[21] Appl. No.: 09/091,553

[22] PCT Filed: Dec. 17, 1996

[86] PCT No.: PCT/NO96/00290

§ 371 Date: Jun. 22, 1998

§ 102(e) Date: Jun. 22, 1998

[87] PCT Pub. No.: WO97/23705

PCT Pub. Date: Jul. 3, 1997

[30] Foreign Application Priority Data

Dec. 22, 1995 [NO] Norway ..... 955270

[51] Int. Cl.[7] ..... B66F 1/00

[52] U.S. Cl. ..... 254/385; 254/386; 166/77.4; 166/77.51; 166/162; 166/170; 166/122; 187/252; 187/253

[58] Field of Search ..... 254/385, 386; 166/77.4, 77.51, 162, 170, 122; 187/252, 253

[56] References Cited

U.S. PATENT DOCUMENTS

| | | | |
|---|---|---|---|
| 3,494,491 | 2/1970 | Sumida | 254/386 |
| 4,027,854 | 6/1977 | Mouton, Jr. . | |
| 4,170,340 | 10/1979 | Mouton, Jr. . | |
| 4,341,373 | 7/1982 | Mouton, Jr. . | |
| 4,890,671 | 1/1990 | Baxter | 166/77.52 |
| 5,205,379 | 4/1993 | Pfleger | 187/253 |

*Primary Examiner*—Donald P. Walsh
*Attorney, Agent, or Firm*—Pillsbury Madison & Sutro LLP

[57] ABSTRACT

A hydraulically-operated hoist is disclosed. The hoist includes a plurality of hydraulic piston/cylinder arrangements, each having an upper end. Two guide rails are disposed in parallel with the hydraulic piston/cylinder arrangements. A self-aligning yoke is connected between the upper ends of the hydraulic piston/cylinder arrangements and is raised and lowered along the two guide rails by the hydraulic piston/cylinder arrangements. The yoke comprises a beam with the two ends. An arm is connected to each end of the beam, extends obliquely upward from the beam, and terminates in a remote end rotatably connected to the upper ends of the hydraulic piston/cylinder arrangements. At least two sheaves are rotatably connected to the beam, each of which are capable of running its own wire line.

4 Claims, 4 Drawing Sheets

ARRANGEMENT IN CONNECTION WITH A YOKE IN A HOISTING SYSTEM FOR A DERRICK

CROSS-REFERENCES TO RELATED APPLICATIONS

Not Applicable.

STATEMENT REGARDING FEDERALLY SPONSORED RESEARCH OR DEVELOPMENT

Not Applicable

BACKGROUND OF THE INVENTION

1. Field of the Invention

The present invention relates to an apparatus in connection with a derrick, comprising two or more hydraulic piston/cylinder arrangements for raising and lowering a yoke which travels on guide rails in the derrick itself.

2. Description of the Related Art Including Information Disclosed Under 37 C.F.R. § § 1.97 and 1.98

A derrick structure, developed by the present inventor in 1987, that has shown great promise is the RamRig™ concept. Two hydraulic piston/cylinder arrangements are used in the derrick for raising and lowering the drill string. The cylinders operate between the drill floor and a yoke which travels on guide rails in the derrick itself. The advantages of this concept are numerous, some of the most important being that it is possible to place the drill floor at a higher level than the platform floor, that a derrick having significantly lower air resistance can be constructed, and that the most expensive components of the derrick attain higher safety and a longer lifetime.

Since it is possible to position the drill floor higher than the platform floor, pipe handling is significantly simplified. There is no longer any need to arrange the pipe handling equipment at a high level in the derrick. All pipe handling equipment can be placed on the platform floor and the drill floor.

BRIEF SUMMARY OF THE INVENTION

The object of the present invention is to solve important, practical problems in the realization of the RamRig™ concept. This object is achieved by means of the features apparent from the characterizing clause of the subsequently disclosed claim 1.

BRIEF DESCRIPTION OF THE SEVERAL VIEWS OF THE DRAWINGS

The invention will now be explained in greater detail with reference to the enclosed drawings, where.

DETAILED DESCRIPTION OF THE INVENTION

Figure 1:
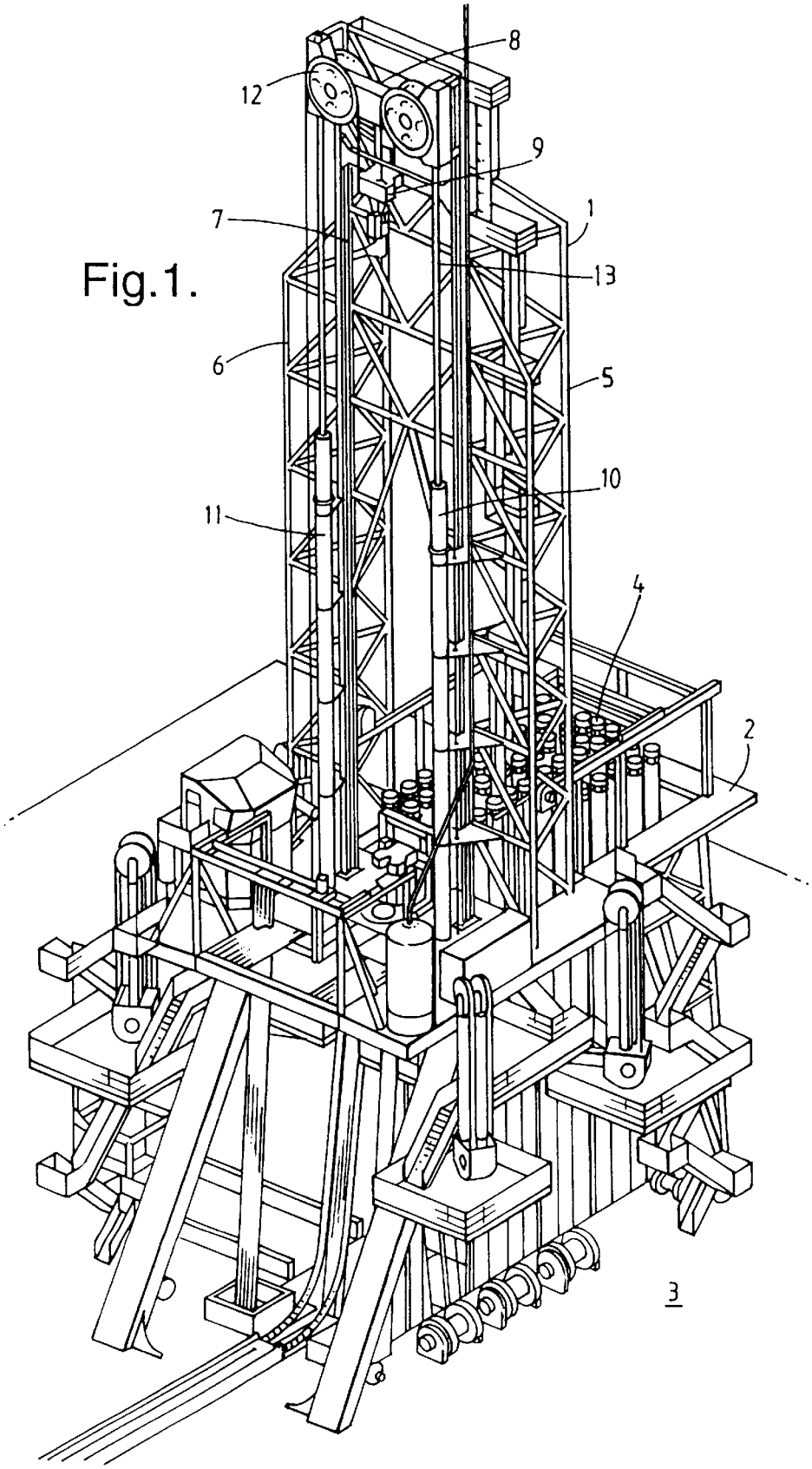
FIG. 1 shows a RamRig™ derrick in every essential detail.

FIG. 1 shows a derrick 1 positioned on a drill floor 2. The drill floor is positioned at a higher level than the platform floor 3, so that the pipe handling equipment 4 can be placed, in the main, between the platform floor 3 and the drill floor 2. The derrick 1 is substantially gantry-shaped, with gantry legs 5, 6. Guide rails 7 for a yoke 8 and a top-drive 9 run along each gantry leg 5, 6. Hydraulic piston/cylinder arrangements 10, 11 are positioned so that they extend along each gantry leg 5, 6 and operate between the drill floor 2 and the yoke 8, for moving the yoke 8 vertically along the guide rails 7.

The yoke 8 is provided with a plurality of sheaves 12, preferably four, for running wire lines 13. The wire lines 13 run from the drill floor 2 along each gantry leg 5, 6, over the sheaves 12 and down to the top drive 9. By retracting and extending the piston/cylinder arrangement 10, 11, it is thus possible to raise and lower the top drive 9.

Figure 2:
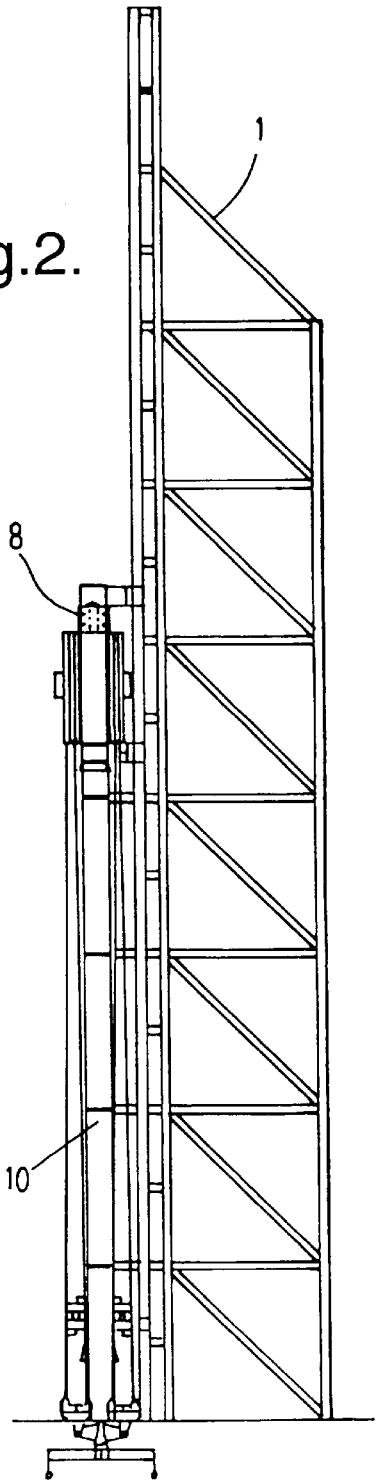
FIG. 2 shows the derrick schematically, viewed from the side.
Figure 3:
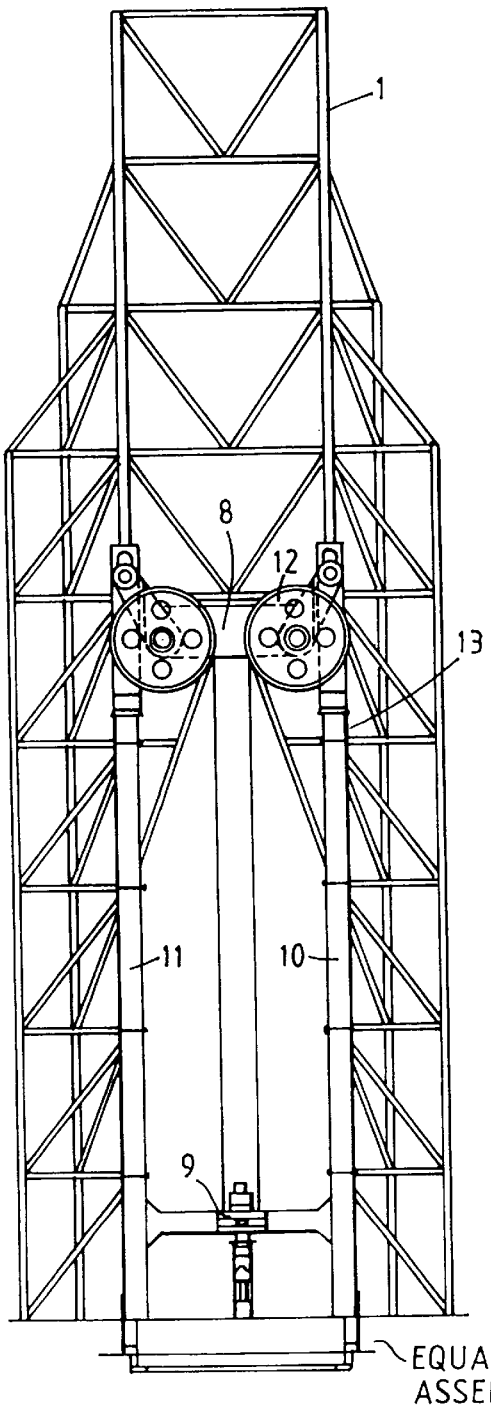
FIG. 3 shows the derrick schematically, viewed from the front, with the top drive in its lowest position.
Figure 4:
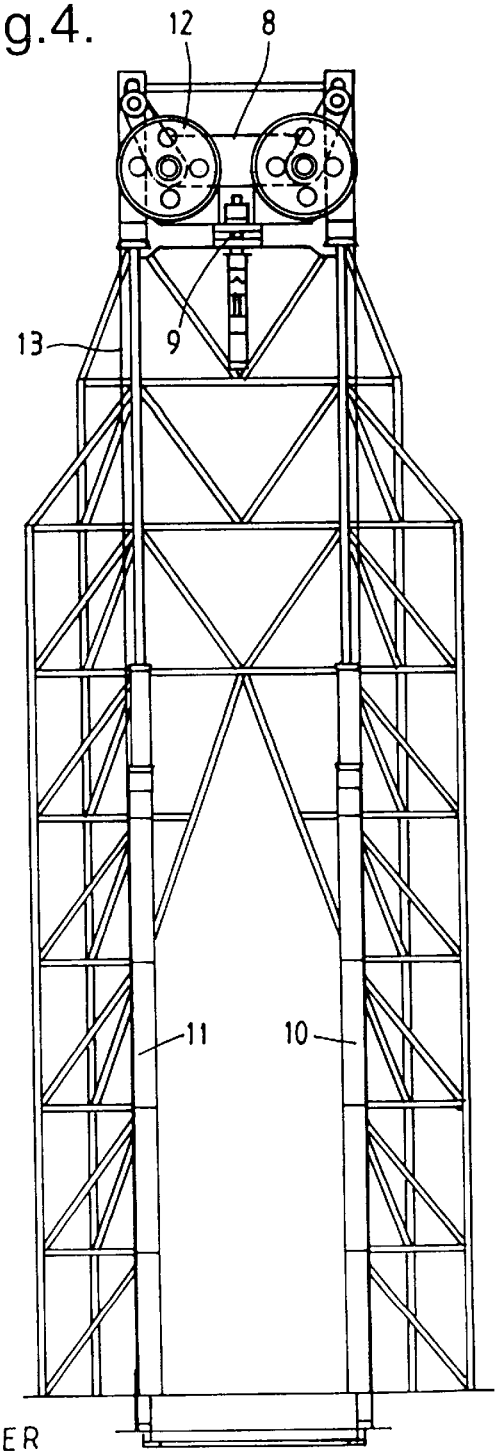
FIG. 4 shows the derrick schematically, viewed from the front, with the top drive in its highest position.

In FIGS. 2, 3 and 4, the function of the lift system is seen most clearly. In FIGS. 2 and 3, the piston/cylinder arrangement 10, 11 is shown in a completely retracted condition. The top drive 9 is then in its lowest position, quite close to the drill floor. The yoke 8 is at the upper end of the piston/cylinder arrangement.

When the pistons in the piston/cylinder arrangement are extended, the yoke 8 is lifted along the guide rails 7 up to the top of the derrick 1. The top drive is then lifted, as a result of the exchange created by the wire lines 13 being run over the sheaves 12, from its position adjacent to the drill floor 2 to a position directly below the yoke 8. The height to which the top drive 9 is lifted is thus the double of that to which the yoke 8 is lifted.

The piston/cylinder arrangement 10 will never provide a lifting force and length of stroke completely identical to that of the piston/cylinder arrangement 11. Therefore, there is a great risk that misalignment of the yoke 8 will occur and that the yoke will become stuck in the guide rails 7. In order to avoid this, it is obviously possible to choose piston/cylinder arrangements of such powerful dimensions that they will overcome such misalignments. The result, however, is that the structure becomes very expensive and heavy. According to the invention, the yoke 8 has therefore been given a special design which will eliminate misalignment and the hazard of becoming stuck.

Figure 6:
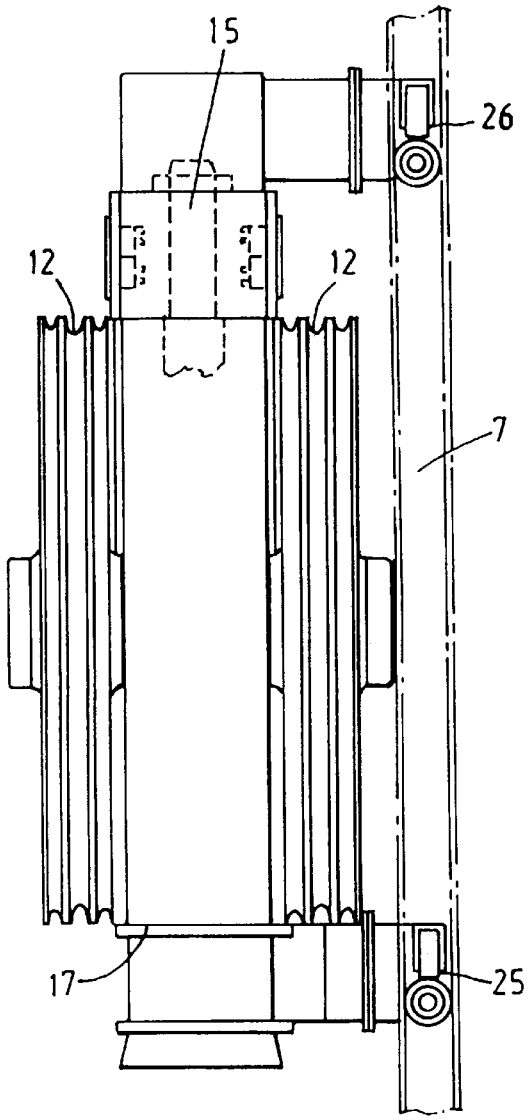
FIG. 6 shows the yoke of FIG. 6, viewed from the side.
Figure 5:
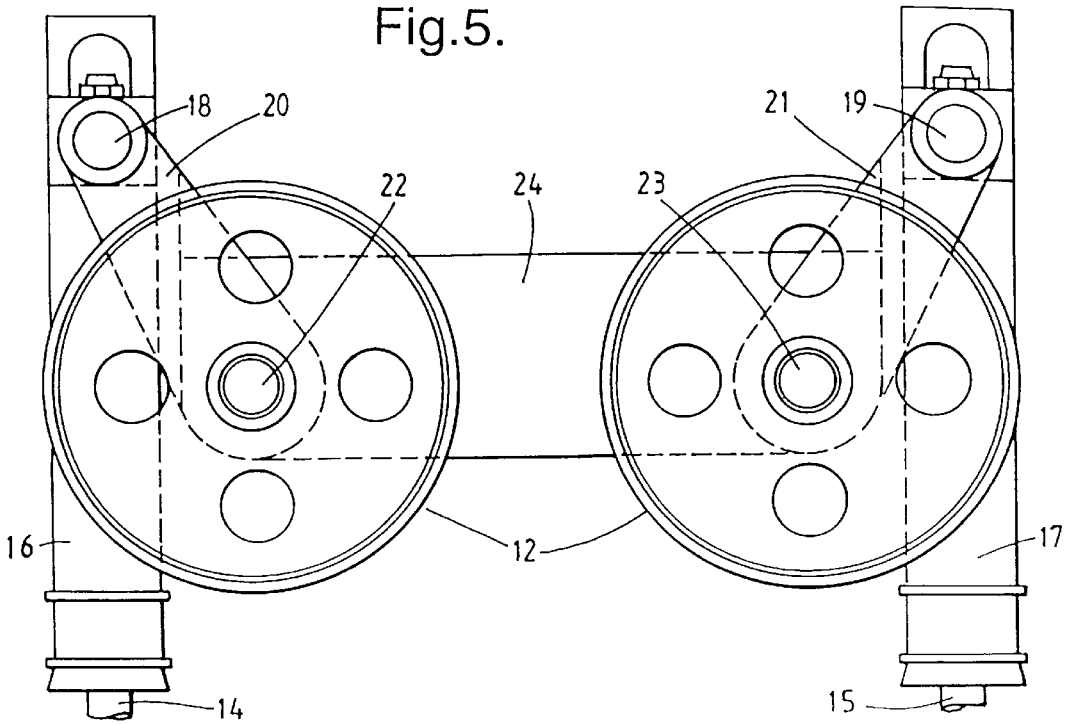
FIG. 5 shows a yoke according to the invention, viewed from the front.

The structure of the yoke 8 is best shown in FIGS. 5 and 6. Each of the piston rods 14 and 15 of the piston/cylinder arrangements 10, 11 is run through its own sleeve 16, 17 in the yoke 8. The top of the piston rods 14, 15 is attached to the top of the sleeves 16, 17 so that the attachment points of the piston rods 14, 15 are located above the sheaves 12.

Arms 20, 21, carrying the sheaves 12 are attached at point 18, respectively point 19, adjacent to the top of the sleeves 16, 17. Each arm 20, 21 carries preferably two sheaves 12 at its end 22, respectively 23, opposite to the attachment points 18, 19. A beam 24, rigidly connected to the arms 20, 21, extends between the ends 22, 23 of the arms 20, 21, and provides a constant distance between the sheaves 12.

As seen from FIG. 6, guide roller assemblies 25, 26 are mounted at the upper and the lower portions of each of the sleeves 16, 17. These engage with the guide rails 7 so that the yoke 8 is only permitted to move along these. FIG. 5 also shows the arrangement of the sheaves 12 in pairs.

Figure 7:
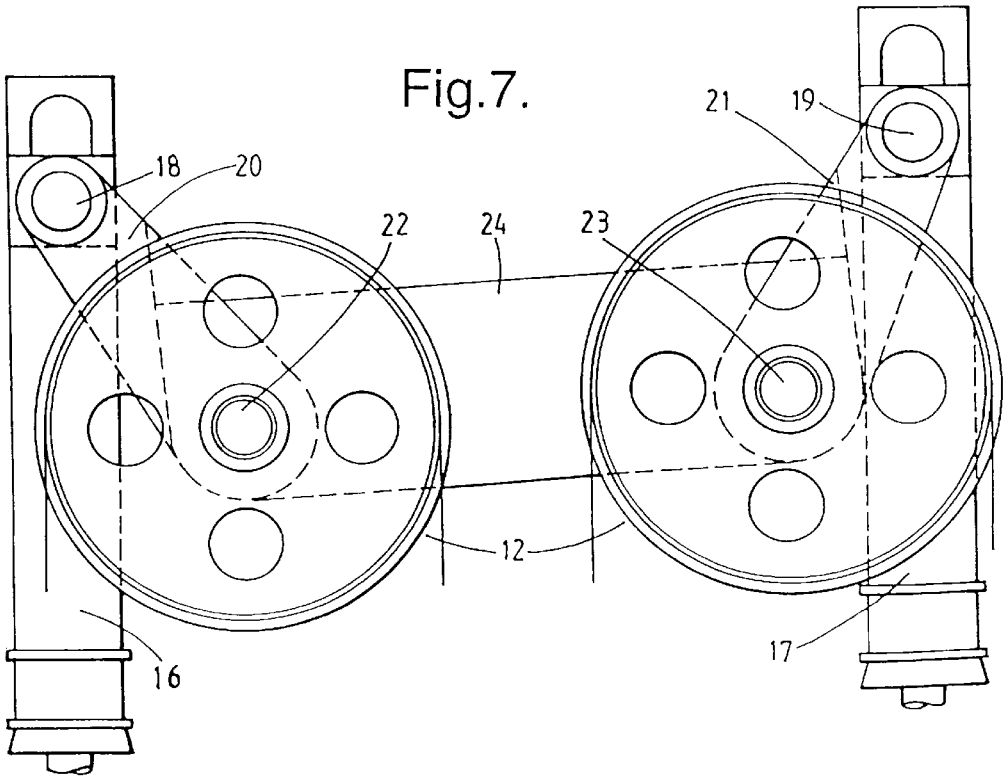
FIG. 7 illustrates the self-adjusting function of the yoke.

When, for example, the piston/cylinder arrangement 10, as seen from FIG. 7, attains a somewhat higher lift position than the opposite piston/cylinder arrangement 11, the beam 24 with the sheaves 12 will be drawn toward the piston/cylinder arrangement 10. Hence, the horizontal distance between the attachment point 19 of the arm 21 in the sleeve 17, and the sheave 12 will decrease, so that the vertical force operating in point 19 will increase. The opposite will occur with respect to the piston/cylinder arrangement 11, where the horizontal distance between the point 18 and the pertaining sheave 12 will increase, so that the vertical force operating in point 18 will decrease. The piston/cylinder arrangement 10 will thus carry a greater portion of the total load than the piston/cylinder arrangement 11 does. The piston/cylinder arrangement 10 will therefore encounter greater resistance than the piston/cylinder arrangement 11 does, and the latter will thus catch up with the piston/cylinder arrangement 10, so that the misalignment will be cancelled before it reaches a value which may have a detrimental effect on the structure.

What is claimed is:

1. A hydraulically-operated hoist, comprising:

a plurality of hydraulic piston/cylinder arrangements, each having an upper end;

two guide rails disposed in parallel with the hydraulic piston/cylinder arrangements;

a self-aligning yoke connected between the upper ends of the hydraulic piston/cylinder arrangements, the yoke being raised and lowered along the two guide rails by the hydraulic piston/cylinder arrangements, the yoke comprising a beam with the two ends, an arm connected to each end of the beam, each arm extending obliquely upward from the beam and terminating in a remote end rotatably connected to the upper ends of the hydraulic piston/cylinder arrangements; and at least two sheaves rotatably connected to the beam, each capable of running its own wire line.

2. The apparatus of claim 1, wherein the at least two sheaves comprise four sheaves attached in pairs to the beam.

3. The apparatus of claim 1, wherein the rotatable connection between the remote ends of the two arms and the upper ends of the hydraulic piston/cylinder arrangements comprises:

a sleeve attached to the upper end of the hydraulic piston/cylinder arrangements, the piston portion of the hydraulic piston/cylinder arrangements passing through the sleeve; and a rigid connection rotatably mounted in an upper portion of each sleeve.

4. The apparatus of claim 2, wherein the rotatable connection between the remote ends of the two arms and the upper ends of the hydraulic piston/cylinder arrangements comprises:

a sleeve attached to the upper end of the hydraulic piston/cylinder arrangements, the piston portion of the hydraulic piston/cylinder arrangements passing through the sleeve; and a rigid connection rotatably mounted in an upper portion of each sleeve.

* * * * *